US006556805B1

(12) United States Patent
Kuo et al.

(10) Patent No.: US 6,556,805 B1
(45) Date of Patent: Apr. 29, 2003

(54) DUAL CAM SET TRANSFER ASSIST BLADE SYSTEM

(75) Inventors: Youti Kuo, Penfield, NY (US); Douglas A. McKeown, Geneseo, NY (US); David K. Ahl, Rochester, NY (US); Robert A. Gross, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 5 days.

(21) Appl. No.: 10/003,242

(22) Filed: Dec. 6, 2001

(51) Int. Cl.[7] ..... G03G 15/16
(52) U.S. Cl. ..... 399/316; 399/389
(58) Field of Search ..... 399/45, 66, 311, 399/316, 317, 389, 390

(56) References Cited

U.S. PATENT DOCUMENTS 5,247,335 A * 9/1993 Smith et al. ..... 399/316
5,300,993 A * 4/1994 Vetromile ..... 399/339
5,300,994 A * 4/1994 Gross et al. ..... 399/339
5,539,508 A * 7/1996 Piotrowski et al. ..... 399/170
5,923,921 A * 7/1999 OuYang et al. ..... 399/66
6,330,418 B1 * 12/2001 Ahl et al. ..... 399/311

FOREIGN PATENT DOCUMENTS

JP 07005778 A * 1/1995 ..... G03G/15/16

* cited by examiner

*Primary Examiner*—Robert Beatty
(74) *Attorney, Agent, or Firm*—Tallam I. Nguti

(57) ABSTRACT

A dual cam set transfer assist blade system comprising (a) a first set of cam and blade assemblies mounted on a rotatable shaft and each including a cam having a single lobe for rotation in a first direction to cause engagement of a first set of transfer assist blade segments corresponding to a first set of sheet widths, and (b) a second set of cam and blade also assemblies mounted on the rotatable shaft and each including a cam having a first lobe for rotation in a first direction to cause engagement of a second set of transfer assist blade segments corresponding to said first set of sheet widths, and a second lobe for rotation in a second direction to cause engagement of said second set of transfer assist blade segments corresponding to a second set of sheet widths.

20 Claims, 5 Drawing Sheets

DUAL CAM SET TRANSFER ASSIST BLADE SYSTEM

RELATED APPLICATIONS

This application is related to U.S. application Ser. No. 10/003,243 entitled "Sequential Transfer Assist Blade Assembly" filed on the same date herewith, and having at least one common inventor.

BACKGROUND OF THE INVENTION

This invention relates generally to electrostatographic printers and copiers or reproduction machines, and more particularly, concerns a dual cam set, segmented transfer assist blade system in which dual sets of cams are rotatable in a first direction and in a second direction for engaging a first set of segmented blades, and a second set of segmented blades, respectively, to contact size image receiving sheets of different widths for assisting in image transfer.

The process of transferring charged toner particles from an image bearing member (e.g. photoreceptor) to an image support substrate (e.g. copy sheet) is enabled by overcoming cohesive forces holding the toner particles to the image bearing member. The interface between the photoreceptor surface and image support substrate is not always optimal. Thus, problems may be caused in the transfer process when spaces or gaps exist between the developed image and the image support substrate. A critical aspect of the transfer process is focused on the application and maintenance of high intensity electrostatic fields in the transfer region for overcoming the cohesive forces acting on the toner particles as they rest on the photoreceptive member. Careful control of these electrostatic fields and other forces is required to induce the physical detachment and transfer-over of the charged toner particles without scattering or smearing of the developer material.

Alternatively, mechanical devices that force the image support substrate into intimate and substantially uniform contact with the image bearing surface have been incorporated into transfer systems. Various contact blade arrangements have been proposed for sweeping the backside of the image support substrate, with a constant force, at the entrance to the transfer region. However, deletions may occur using these methods, especially in duplex copying.

SUMMARY OF INVENTION

In accordance with the present invention, there is provided a dual cam set transfer assist blade system comprising (a) a first set of cam and blade assemblies mounted on a rotatable shaft and each including a cam having a single lobe for rotation in a first direction to cause engagement of a first set of transfer assist blade segments corresponding to a first set of sheet widths, and (b) a second set of cam and blade also assemblies mounted on the rotatable shaft and each including a cam having a first lobe for rotation in a first direction to cause engagement of a second set of transfer assist blade segments corresponding to said first set of sheet widths, and a second lobe for rotation in a second direction to cause engagement of said second set of transfer assist blade segments corresponding to a second set of sheet widths.

BRIEF DESCRIPTION OF THE DRAWINGS

Other features of the present invention will become apparent as the following description proceeds and upon reference to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
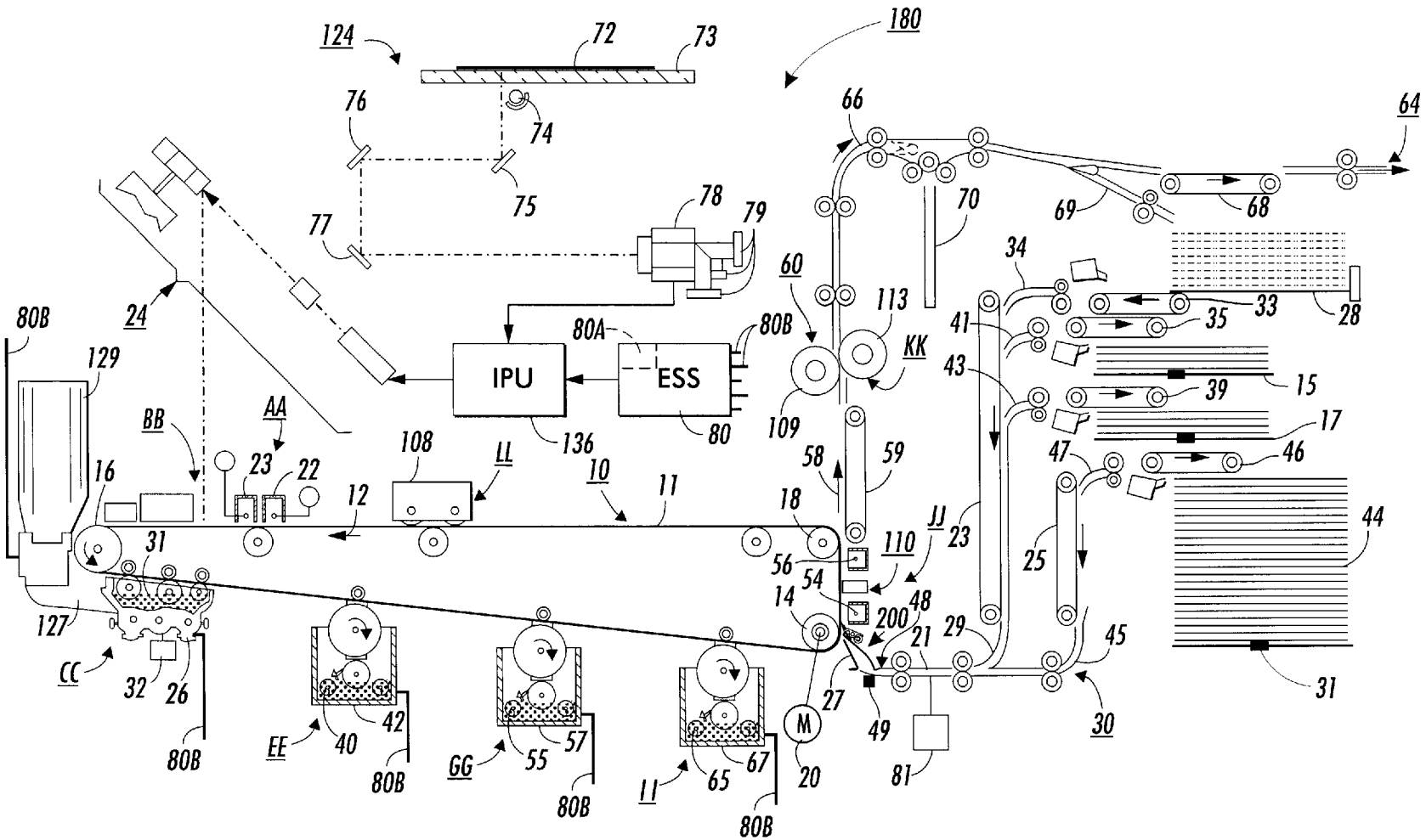
FIG. 1 is a schematic illustration of a electrostatographic reproduction machine incorporating the dual cam set transfer assist blade system of the present invention.

Referring first to FIG. 1, there is depicted an exemplary electrostatographic reproduction machine, for example, a multipass color electrostatographic reproduction machine 180. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light. The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS) 80 including the dual cam set transfer-assist blade system 200 in accordance with the present invention (to be described in detail below).

The ESS is preferably a self-contained, dedicated mini-computer having a central processor unit (CPU), electronic storage, and a display or user interface (UI). The ESS is the control system which with the help of sensors and connections 80B as well as a pixel counter 80A, reads, captures, prepares and manages the image data flow between IPU 136 and image input terminal 122, 124. In addition, the ESS 80 is the main multi-tasking processor for operating and controlling all of the other machine subsystems and printing operations. These printing operations include imaging, development, sheet delivery and transfer, and particularly the dual cam set transfer-assist blade 200 in accordance with the present invention. Such operations also include various functions associated with subsequent finishing processes. Some or all of these subsystems may have micro-controllers that communicate with the ESS 80.

The multipass color electrostatographic reproduction machine 180 employs a photoreceptor 10 in the form of a belt having a photoconductive surface layer 11 on an electroconductive substrate 13. Preferably the surface 11 is made from an organic photoconductive material, although numerous photoconductive surfaces and conductive substrates may be employed. The belt 10 is driven by means of motor 20 having an encoder attached thereto (not shown) to generate a machine timing clock. Photoreceptor 10 moves along a path defined by rollers 14, 18, and 16 in a counterclockwise direction as shown by arrow 12.

Initially, in a first imaging pass, the photoreceptor 10 passes through charging station AA where a corona generating devices, indicated generally by the reference numeral 22, 23, on the first pass, charge photoreceptor 10 to a relatively high, substantially uniform potential. Next, in this first imaging pass, the charged portion of photoreceptor 10 is advanced through an imaging station BB. At imaging station BB, the uniformly charged belt 10 is exposed to the scanning device 24 forming a latent image by causing the photoreceptor to be discharged in accordance with one of the color separations and bit map outputs from the scanning device 24, for example black. The scanning device 24 is a laser Raster Output Scanner (ROS). The ROS creates the first color separation image in a series of parallel scan lines having a certain resolution, generally referred to as lines per inch. Scanning device 24 may include a laser with rotating polygon mirror blocks and a suitable modulator, or in lieu thereof, a light emitting diode array (LED) write bar positioned adjacent the photoreceptor 10.

At a first development station CC, a non-interactive development unit, indicated generally by the reference numeral 26, advances developer material 31 containing carrier particles and charged toner particles at a desired and controlled concentration into contact with a donor roll, and the donor roll then advances charged toner particles into contact with the latent image and any latent target marks. Development unit 26 may have a plurality of magnetic brush and donor roller members, plus rotating augers or other means for mixing toner and developer.

A special feature of non-interactive development is that adding and admixing can continue even when development is disabled. Therefore the timing algorithm for the adding and admixing function can be independent of that for the development function, as long as admixing is enabled whenever development is required. These donor roller members transport negatively charged black toner particles for example, to the latent image for development thereof which tones the particular (first) color separation image areas and leaves other areas untoned. Power supply 32 electrically biases development unit 26. Development or application of the charged toner particles as above typically depletes the level and hence concentration of toner particles, at some rate, from developer material in the development unit 26. This is also true of the other development units (to be described below) of the machine 180.

Accordingly, different jobs of several documents being reproduced, will cause toner depletion at different rates depending on the sustained, copy sheet area toner coverage level of the images thereof being reproduced. In a machine using two component developer material as here, such depletion undesirably changes the concentration of such particles in the developer material. In order to maintain the concentration of toner particles within the developer material (in an attempt to insure the continued quality of subsequent images), the adding and admixing function of the development unit must be operating or turned "on" for some controlled period of time in order for the device 127 to replenish the development unit such as 26 with fresh toner particles from the source 129. Such fresh toner particles must then be admixed with the carrier particles in order to properly charge them triboeletrically.

On the second and subsequent passes of the multipass machine 180, the pair of corona devices 22 and 23 are employed for recharging and adjusting the voltage level of both the toned (from the previous imaging pass), and untoned areas on photoreceptor 10 to a substantially uniform level. A power supply is coupled to each of the electrodes of corona recharge devices 22 and 23. Recharging devices 22 and 23 substantially eliminate any voltage difference between toned areas and bare untoned areas, as well as to reduce the level of residual charge remaining on the previously toned areas, so that subsequent development of different color separation toner images is effected across a uniform development field.

Imaging device 24 is then used on the second and subsequent passes of the multipass machine 180, to superimpose subsequent a latent image of a particular color separation image, by selectively discharging the recharged photoreceptor 10. The operation of imaging device 24 is of course controlled by the controller, ESS 80. One skilled in the art will recognize that those areas developed or previously toned with black toner particles will not be subjected to sufficient light from the imaging device 24 as to discharge the photoreceptor region lying below such black toner particles. However, this is of no concern as there is little likelihood of a need to deposit other colors over the black regions or toned areas.

Thus on a second pass, imaging device 24 records a second electrostatic latent image on recharged photoreceptor 10. Of the four development units, only the second development unit 42, disposed at a second developer station EE, has its development function turned "on" (and the rest turned "off") for developing or toning this second latent image. As shown, the second development unit 42 contains negatively charged developer material 40, for example, one including yellow toner. The toner 40 contained in the development unit 42 is thus transported by a donor roll to the second latent image recorded on the photoreceptor 10, thus forming additional toned areas of the particular color separation on the photoreceptor 10. A power supply (not shown) electrically biases the development unit 42 to develop this second latent image with the negatively charged yellow toner particles 40. As will be further appreciated by those skilled in the art, the yellow colorant is deposited immediately subsequent to the black so that further colors that are additive to yellow, and interact therewith to produce the available color gamut, can be exposed through the yellow toner layer.

On the third pass of the multipass machine 180, the pair of corona recharge devices 22 and 23 are again employed for recharging and readjusting the voltage level of both the toned and untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas, as well as to reduce the level of residual charge remaining on the previously toned areas so that subsequent development of different color toner images is effected across a uniform development field. A third latent image is then again recorded on photoreceptor 10 by imaging device 24. With the development functions of the other development units turned "off", this image is developed in the same manner as above using a third color toner 55 contained in a development unit 57 disposed at a third developer station GG. An example of a suitable third color toner is magenta. Suitable electrical biasing of the development unit 57 is provided by a power supply, not shown.

On the fourth pass of the multipass machine 180, the pair of corona recharge devices 22 and 23 again recharge and adjust the voltage level of both the previously toned and yet untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas as well as to reduce the level of residual charge remaining on the previously toned areas. A fourth latent image is then again created using imaging device 24. The fourth latent image is formed on both bare areas and previously toned areas of photoreceptor 10 that are to be developed with the fourth color image. This image is developed in the same manner as above using, for example, a cyan color toner 65 contained in development unit 67 at a fourth developer station II. Suitable electrical biasing of the development unit 67 is provided by a power supply, not shown.

Following the black development unit 26, development units 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein. In order to condition the toner for effective transfer to a substrate, a negative pre-transfer corotron member 50 negatively charges all toner particles to the required negative polarity to ensure proper subsequent transfer.

Since the machine 180 is a multicolor, multipass machine as described above, only one of the plurality of development units, 26, 42, 57 and 67 may have its development function turned "on" and operating during any one of the required number of passes, for a particular color separation image development. The remaining development units must thus have their development functions turned off. As pointed out above and to be addressed below, the conventional approach is to use the same timing for the development function and the adding and admixing function, which causes design and operating conflicts in determining and effecting a control method for the "on" time for each development unit, particularly during sustained high area toner coverage jobs, in order to insure continued reproduction of high quality images without risking a quality or productivity degradation, or customer dissatisfaction.

Still referring to FIG. 1, during the exposure and development of the last color separation image, for example by the fourth development unit 6, 7 a sheet SS of support material is advanced to a transfer station JJ by a sheet feeding apparatus 30 that includes a sheet size or width sensor 31 connected to ESS or controller 80. During simplex operation (single sided copy), a blank sheet SS may be fed from tray 15 or tray 17, or a high capacity tray 44 thereunder, to a registration transport 21, in communication with ESS or controller 80, where the sheet is registered in the process and lateral directions, and for skew position. One skilled in the art will realize that trays 15, 17, and 44 may each hold a different sheet type, and includes its own sheet size sensor mechanism. The speed of the sheet SS is adjusted at registration transport 21 so that the sheet arrives at transfer station JJ in synchronization with the composite multicolor image on the surface of photoconductive belt 10.

Registration transport 21 receives a sheet from either a vertical transport 23 or a high capacity tray transport 25 and moves the received sheet to pretransfer baffles 27. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet SS from trays 15 and 17 to the vertical transport 23 by chutes 41 and 43. The high capacity tray transport 25 receives the sheet from tray 44 and guides it to the registration transport 21 via a lower baffle 45. A sheet feeder 46 advances copy sheets SS from tray 44 to transport 25 by a chute 47.

The pretransfer baffles 27 guide the sheet SS from the registration transport 21 to transfer station JJ. Charge limiter 49 located on pretransfer baffles 27 restricts the amount of electrostatic charge a sheet can place on the baffles 27 thereby reducing image quality problems and shock hazards. The charge can be placed on the baffles from either the movement of the sheet through the baffles or by the corona generating devices located at transfer station JJ. When the charge exceeds a threshold limit, charge limiter 49 discharges the excess to ground.

Transfer station JJ includes a transfer corona device 54 which provides positive ions to the backside of the copy sheet SS. This attracts the negatively charged toner powder images from photoreceptor belt 10 to the sheet SS. A detack corona device 56 is provided for facilitating stripping of the sheet SS from belt 10. A sheet-to-image registration detector 110 is located in the gap between the transfer and corona devices 54 and 56 to sense variations in actual sheet to image registration and provides signals indicative thereof to ESS 80 and ESS or controller 80 while the sheet SS is still tacked to photoreceptor belt 10.

The transfer station JJ also includes the dual cam set transfer assist blade system 200 of the present invention, (to be described in detail below). After transfer, the sheet SS continues to move, in the direction of arrow 58, onto a conveyor 59 that advances the sheet to fusing station KK.

Fusing station KK includes a fuser assembly, indicated generally by the reference numeral 60, which permanently fixes the transferred color image to the copy sheet. Preferably, fuser assembly 60 comprises a heated fuser roller 109 and a backup or pressure roller 113. The copy sheet passes between fuser roller 109 and backup roller 113 with the toner powder image contacting fuser roller 109. In this manner, the multi-color toner powder image is permanently fixed to the sheet. After fusing, chute 66 guides the advancing sheet to feeder 68 for exit to a finishing module (not shown) via output 64. However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station JJ, in the same manner as the image was deposited on the first side thereof. The completed duplex copy exits to the finishing module (not shown) via output 64.

After the sheet of support material is separated from photoreceptor 10, the residual toner carried on the photoreceptor surface is removed therefrom. The toner is removed at cleaning station L using a cleaning brush structure contained in a unit 108.

Referring now to FIGS. 1–7, the dual cam set transfer assist blade system 200 as variously illustrated includes a first set of cam and blade assemblies 202 each including a cam 204, 206, 208, 210, 212 having a single lobe 214, 216, 218, 220, 222 (FIGS. 3*a*–3*b*) for rotation in a first direction 224 to cause engagement of a first set of transfer assist blade segments 226, 228, 230, 232 corresponding to a first set of sheets having sheet widths A2, A2+2×B2, and A2+2×B2+2×C2. The dual cam set transfer assist blade system 200 includes a second set of cam and blade assemblies 234 each including a cam 236, 238 (FIGS. 3*a* and 3*b*) and having a first lobe 240 for rotation in the first direction 224 to cause engagement of a second set of is transfer assist blade segments 242, 244 which together have a length D1. This second set of transfer assist blade segments 242, 244, together with the first set of blade segments 226, 228, 230, 232 are variously sufficient for contacting and assisting in image transfer onto sheets having sheet widths A2, A2+2×B2, and A2+2×B2+2×C2. Each cam 236, 238 of the second set of cam and blade assemblies 234 also includes a second lobe 246 for rotation in a second direction 248 to cause engagement of the second set of transfer assist blade segments 242, 244 for contacting and assisting image transfer onto an off center small size sheet SS4 having a width D2.

Specifically, the first set of cam and blade assemblies 202 includes a first blade segment 226 having a length Ar, and the second cam and blade assemblies 234 includes a second blade segment 242 having a length Af.

Together Ar and Af add up to a total first length (A1) for first contacting a first type of size image receiving sheet SS1 that has a first center located at midpoint CL of length A1, and a first width (A2). In addition, the first set of cam and blade assemblies 202 includes a third blade segment 228 and the second cam and blade assemblies 234 includes a fourth blade segment 244 that each have a second length (B1). The third and fourth blade segments are located adjacent outer ends of the first 226 and the second 242 blade segments respectively. Together, the first 226, the second 242, the third 228, and the fourth 244 blade segments have a total length of A1+2×B1 for contacting a second type of size image receiving sheet having a second width (A2+2×B2) where B2 relative to A2, is the additional or incremental dimension of this second sheet SS2 to each side of the center.

The first set of cam and blade assemblies also includes a fifth blade segment 230 and a sixth blade segment 232 that each have a third length (C1). As shown each is located adjacent outer ends of the third and the fourth blade segments 228, 244 respectively. Together, the first 226, the second 242 the third 228, the fourth 244, the fifth 230 and the sixth 232 blade segments have a total length of A1+2×B1+2×C1 for contacting a third size image receiving sheet SS3 having a third width (A2+2×B2+2×C2).

The single lobes 214, 216, 218, 220, 222 of cams of the first set of cam and blade assemblies 202, and the first lobes 240 of cams of the second set of cam and blade assemblies 234 are arranged on a single cam shaft 250 for sequential engagement of blades during rotation in the first direction 224. The second lobes 246 of cams of the second set of cam and blade assemblies 234 are arranged on the single cam shaft 250 for simultaneous engagement of blade segments 242, 244 during rotation in the second direction 248. The first set of cam and blade assemblies and the cams of the second set of cam and blade assemblies all have a common home position.

The cam shaft 250 also includes a drive means in the form of a stepper motor 240 for rotatably moving the rotatable cam shaft 250. In accordance with an aspect of the present invention, the stepper motor 240 is reversible, or is bi-directional for first moving the cam shaft 250 in one direction to engage and contact their corresponding blades, and then in the opposite direction to disengage the cams from such blades.

The dual cam set transfer assist blade system 200 also comprises a ESS or controller 80 that is connected to the stepper motor 240 for controlling a degree of rotation of the rotatable cam shaft 250, and hence the sequential engagement of the cams and the blades of the system 200. The ESS or controller 80 is also connected to a sheet width sensor 31 (FIG. 1) and is programmable to rotate the rotatable cam shaft 250 a predetermined number of motor steps for making blade-to-sheet contact based on a sensed width A2 or A2+2×B2 or A2+2×B2+2×C2, of the size image receiving sheet.

In addition to applying contact pressure, each blade segment of the dual cam set transfer assist blade system 200 should only make contact with the back side of the image receiving sheet so as to avoid blade contact with the image or background toners on photoreceptor outside the image area or beyond the width of the sheet. A blade segment whose width is wider than a sheet has a risk of not only abrading the photoreceptor but also contaminating the edge of the blade with background toners from areas outside of the width of the sheet. The blade in such a case will have to require cleaning, thus adding significant cost, as well as impacting the reliability of the transfer subsystem.

Figure 2:
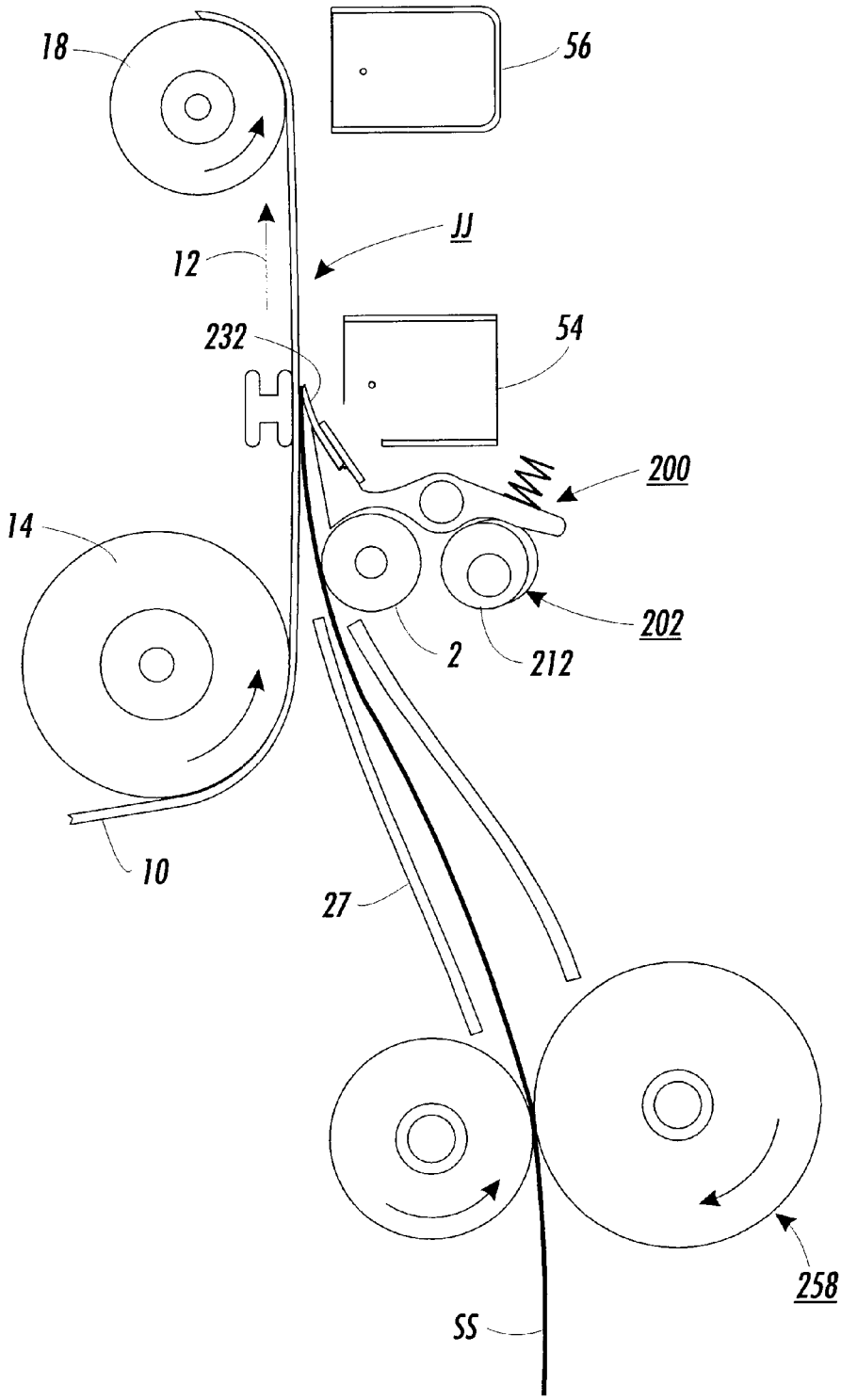
FIG. 2 is a schematic illustration of an enlarged portion of the machine of FIG. 1 showing the dual cam set transfer assist blade system of the present invention.
Figure 3A:
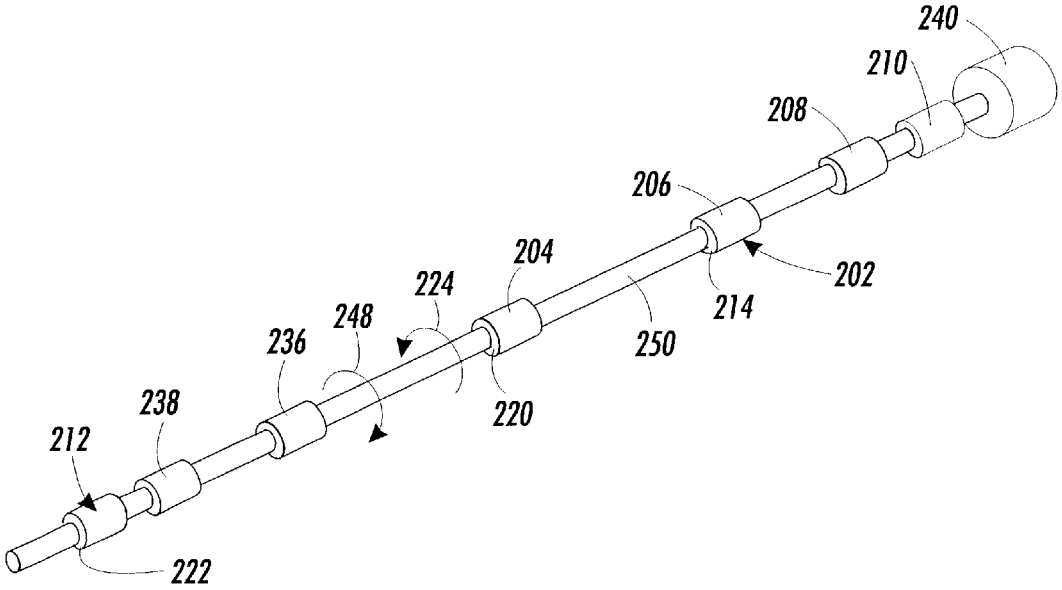
FIGS. 3*a*–3*c* is a perspective illustration of a multiple cam shaft assembly of the dual cam set transfer assist blade system of the present invention.
Figure 3B:
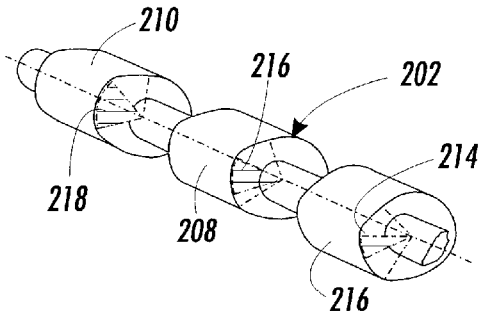
Figure 3C:
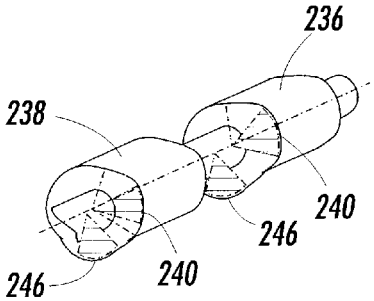
Figure 4:
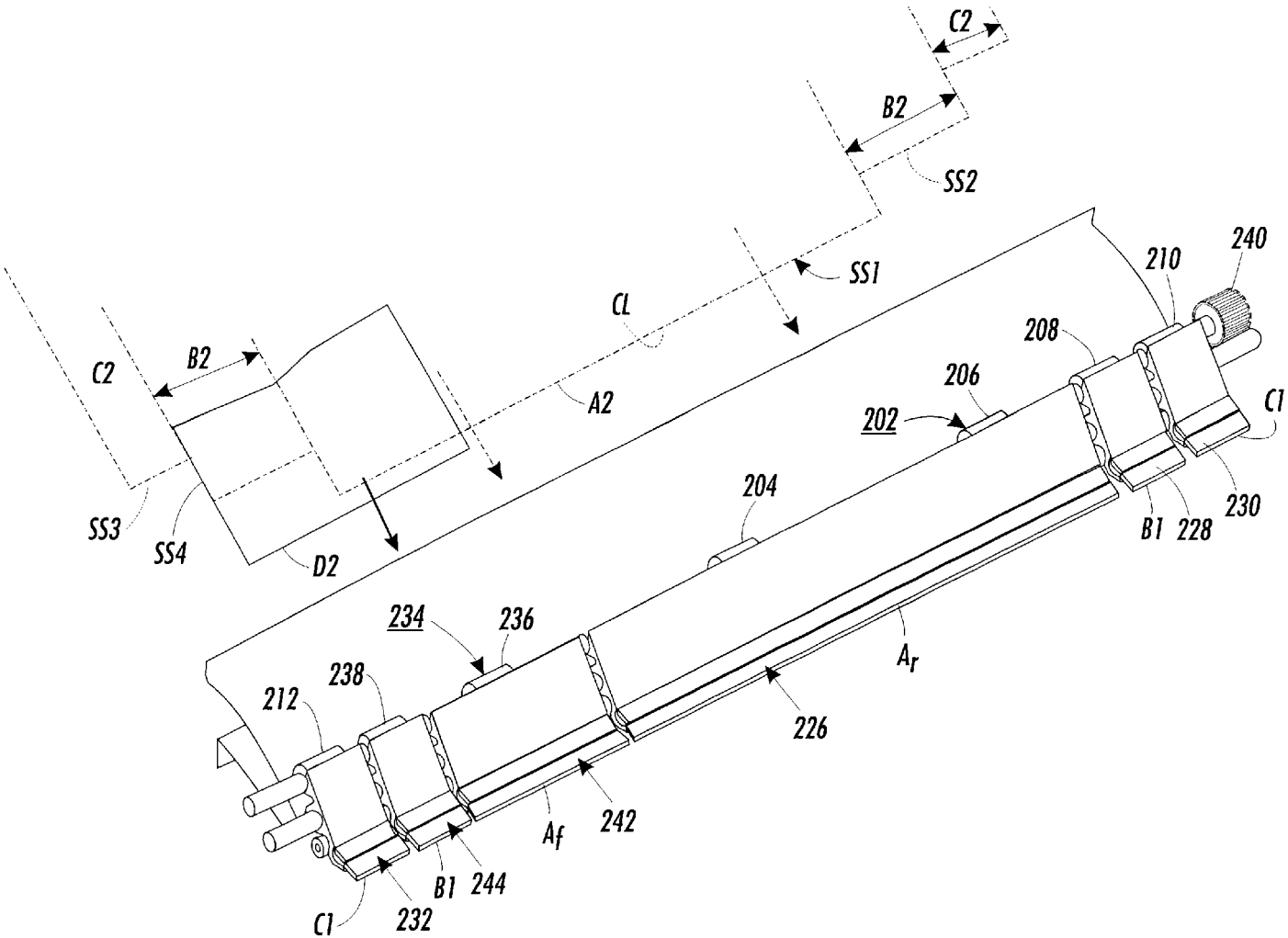
FIG. 4 is a perspective illustration of different sheet widths in relation to spacings of the multiple cams of the first set of cam and blade assemblies of the dual cam set transfer assist blade system of the present invention.

As shown in FIG. 2, the dual cam set transfer assist blade system 200 include registration rolls 258 for providing input sheets SS to the transfer station JJ, and corotron devices 54, 56 for applying electrostatic charge to sheets SS at the transfer station JJ.

Figure 5:
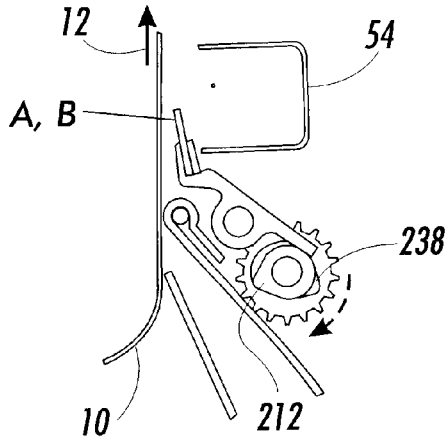
FIG. 5 is a vertical side view of the second set cam and blade assemblies of the dual cam set transfer assist blade of the present invention with all blades at home position.
Figure 7:
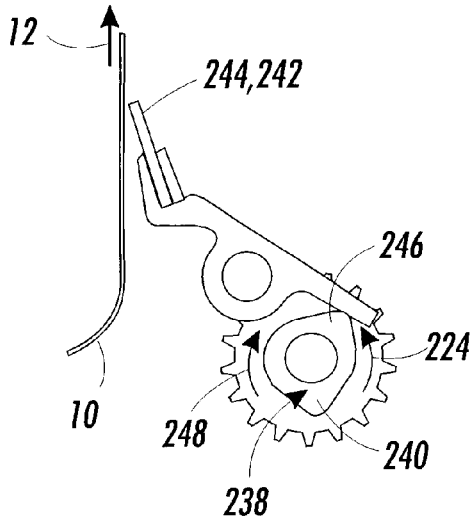
FIG. 7 is a vertical side view of the second set of cam and blade assemblies of the dual cam set transfer assist blade system of the present invention with selective engagement of blades by the dual-lobe cams.

As pointed out above, all the cams are mounted on the cam shaft 250 so as to have a common home position, and such that, at the home position, all blades are fully lifted from the photoreceptor 10 and hence from the sheet SS as shown in FIG. 5. Furthermore, the cams are also arranged so that when each cam has been rotated to its maximum radius point, its corresponding blade segment or segments will be fully lowered and in contact with the appropriate sheet, as shown in FIG. 7 for contacting off-center, small width sheets, having a width D2.

Figure 6:
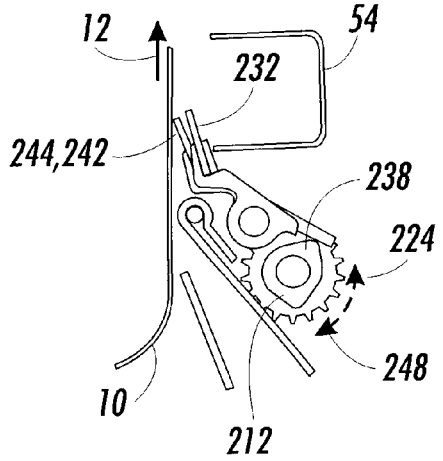
FIG. 6 is a vertical side view of the second set of cam and blade assemblies of the dual cam set transfer assist blade system of the present invention with blades B/D activated by the dual-lobe cam thereof.

FIG. 6 shows an alignment of the dual-profile cams 236, 238 with corresponding blades 242 and 244 for acting on an off-centered small sheet. SS4 having the width D2. FIGS. 5 and 6 illustrate the orientation as well as the home position and the engagement position of the dual-profile cams 236, 238 with corresponding blade segments 242, 244 for engaging the off-center small width sheet D2. FIG. 7 shows a full view of a dual-profile cam engaging with a blade segment.

As can be seen, there has been provided a dual cam set transfer assist blade system comprising (a) a first set of cam and blade assemblies mounted on a rotatable shaft and each including a cam having a single lobe for rotation in a first direction to cause engagement of a first set of transfer assist blade segments corresponding to a first set of sheet widths, and (b) a second set of cam and blade also assemblies mounted on the rotatable shaft and each including a cam having a first lobe for rotation in a first direction to cause engagement of a second set of transfer assist blade segments corresponding to said first set of sheet widths, and a second lobe for rotation in a second direction to cause engagement of said second set of transfer assist blade segments corresponding to a second set of sheet widths.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims.

What is claimed is:

1. A dual cam set transfer assist blade (TAB) system for use at an image transfer station of an image reproduction machine to effectively contact size image receiving sheets of various widths, the dual cam set TAB system comprising:

a. a first set of cam and blade assemblies mounted on a rotatable shaft and each including a cam having a single lobe for rotation in a first direction to cause engagement of a first set of transfer assist blade segments corresponding to a first set of sheet widths, and b. a second set of cam and blade assemblies mounted on said rotatable shaft and each including a cam having a first lobe for rotation in a first direction to cause engagement of a second set of transfer assist blade segments corresponding to said first set of sheet widths, and a second lobe for rotation in a second direction to cause engagement of said second set of transfer assist blade segments corresponding to a second set of sheet widths.

2. The dual cam set transfer assist blade system of claim 1, wherein said first set of cam and blade assemblies includes a first blade segment and said second cam and blade assemblies includes a second blade segment, said first blade segment and said second blade segment having a total first length (A1) for first contacting a first type of size image receiving sheet having a first center location and a first width (A2).

3. The dual cam set transfer assist blade system of claim 1, wherein said first set of cam and blade assemblies includes a third blade segment and said second cam and blade assemblies includes a fourth blade segment, said third and fourth blade segments each having a second length (B1), and each being located adjacent outer ends of said first and said second blade segments respectively, said first, said second, said third and said fourth blade segments having a total length of A1+2×B1 for contacting a second type of size image receiving sheet having a second width (A2+2×B2).

4. The dual cam set transfer assist blade system of claim 1, wherein said first set of cam and blade assemblies includes a fifth blade segment and a sixth blade segment, said fifth and sixth blade segments each having a third length (C1), and each being located adjacent outer ends of said third and said fourth blade segments respectively, said first, said second said third, said fourth, said fifth and said sixth blade segments having a total length of A1+2×B1+2×C1 for contacting a third type of size image receiving sheet having a third width (A2+2×B2+2×C2).

5. The dual cam set transfer assist blade system of claim 1, wherein said single lobes of cams of said first set of cam and blade assemblies, and said first lobes of cams of said second set of cam and blade assemblies are arranged on a single cam shaft for sequential engagement of blades during rotation in said first direction.

6. The dual cam set transfer assist blade system of claim 5, wherein said second lobes of cams of said second set of cam and blade assemblies are arranged on said single cam shaft for simultaneous engagement of blades during rotation in said second direction.

7. The dual cam set transfer assist blade system of claim 5, including a stepper motor for rotatably moving said single cam shaft.

8. The dual cam set transfer assist blade system of claim 5, wherein said cams of said first set of cam and blade assemblies and said cams of said second set of cam and blade assemblies all have a common home position.

9. The dual cam set transfer assist blade system of claim 5, including a controller connected to said stepper motor for controlling a direction, and a degree, of rotation of said single cam shaft.

10. The dual cam set transfer assist blade system of claim 7, wherein said stepper motor is reversible.

11. The dual cam set transfer assist blade system of claim 8, including a home position sensor.

12. The dual cam set transfer assist blade system of claim 9, wherein said controller is connected to a sheet width sensor and is programmed to rotate said rotatable cam shaft a predetermined number of motor steps for making blade-to-sheet contact based on a sensed width of the size image receiving sheet.

13. A dual cam set transfer assist blade (TAB) assembly for contacting size image receiving sheets having different sheet widths at an image transfer station in a reproduction machine, the dual cam set TAB assembly comprising:

a. plural blade support levers including first, second, third, fourth, fifth and sixth blade support levers, each said support levers being pivotable;

b. a rotatable cam shaft assembly including a cam shaft, a drive means for rotating said cam shaft, and (i) a first set of cam and blade assemblies each including a cam having a single lobe for rotation in a first direction to cause engagement of a first set of transfer assist blade segments corresponding to a first set of sheet widths, and (ii) a second set of cam and blade assemblies each including a cam having a first lobe for rotation in a first direction to cause engagement of a second set of transfer assist blade segments corresponding to said first set of sheet widths, and a second lobe for rotation in a second direction to cause engagement of said second set of transfer assist blade segments corresponding to a second set of sheet widths.

14. The dual cam set transfer assist blade system of claim 13, including a stepper motor for rotatably moving said single cam shaft.

15. The dual cam set transfer assist blade system of claim 13, wherein said cams of said first set of cam and blade assemblies and said cams of said second set of cam and blade assemblies all have a common home position.

16. The dual cam set transfer assist blade system of claim 13, including a controller connected to said stepper motor for controlling a direction, and a degree, of rotation of said single cam shaft.

17. The dual cam set transfer assist blade system of claim 14, wherein said stepper motor is reversible.

18. The dual cam set transfer assist blade system of claim 15, including a home position sensor.

19. The dual cam set transfer assist blade system of claim 16, wherein said controller is connected to a sheet width sensor and is programmed to rotate said rotatable cam shaft a predetermined number of motor steps for making blade-to-sheet contact based on a sensed width of the size image receiving sheet.

20. An electrostatographic reproduction machine comprising:

a. a moveable image bearing member having an imaging surface for carrying a toner image;

b. a sheet supply and handling assembly for supplying and moving size image receiving sheets of various widths into a toner image transfer relationship with said image bearing member;

c. imaging devices for forming a toner image on said imaging surface for transfer to size image receiving sheets; and d. a dual cam set transfer assist blade (TAB) system for contacting size image receiving sheets of various widths, the TAB system including:

(i) a first set of cam and blade assemblies each including a cam having a single lobe for rotation in a first direction to cause engagement of a first set of transfer assist blade segments corresponding to a first set of sheet widths, and (ii) a second set of cam and blade assemblies each including a cam having a first lobe for rotation in a first direction to cause engagement of a second set of transfer assist blade segments corresponding to said first set of sheet widths, and a second lobe for rotation in a second direction to cause engagement of said second set of transfer assist blade segments corresponding to a second set of sheet widths.

* * * * *